United States Patent [19]

Wood

[11] 4,323,174

[45] Apr. 6, 1982

[54] APPARATUS FOR DISPENSING MASTIC MATERIAL

[76] Inventor: Thomas J. Wood, 25, Chalfont Close, Bedworth, Near Nuneaton, Warwickshire, England

[21] Appl. No.: 194,392

[22] Filed: Oct. 6, 1980

[30] Foreign Application Priority Data

Oct. 11, 1979 [GB] United Kingdom ..... 35379/79

[51] Int. Cl.[3] ..... B67D 5/62

[52] U.S. Cl. ..... 222/146 H; 222/146 HE; 222/413

[58] Field of Search ..... 222/146 R, 146 H, 146 HE, 222/410, 413

[56] References Cited

U.S. PATENT DOCUMENTS

| | | | |
|---|---|---|---|
| 3,598,282 | 8/1971 | Phillips et al. | 222/146 HE |
| 3,910,323 | 10/1975 | Harding et al. | 222/146 H X |
| 4,096,973 | 6/1978 | Checko | 222/146 HE |

*Primary Examiner*—Joseph J. Rolla

*Attorney, Agent, or Firm*—Watson, Cole, Grindle & Watson

[57] ABSTRACT

Apparatus for dispensing mastic material such as butyle mastic sealant consists of a hopper for receiving cold mastic material and which is arranged to be heated to soften the material for feeding towards an outlet by a feed screw in a lower longitudinal receptacle. A pre-heating coil is provided in the hopper and a lower part of the latter and the lower receptacle and an outlet barrel are housed in a tank containing a heating fluid such as oil heated by thermostatically controlled immersion heaters to maintain the mastic material in the required softened condition in the hopper receptacle and barrel. Heated oil from the tank is circulated through the pre-heating coil. A reduced continuation of the feed screw operates in the barrel for force feed of the heat softened mastic material to the outlet. In use an applicator nozzle or gun is connected by a hose to the outlet. Both the hose and gun are heated to maintain the mastic material in a required softened condition up to the point of issue from the gun. Operation of the gun may also control operation of the feed screw drive.

8 Claims, 1 Drawing Figure

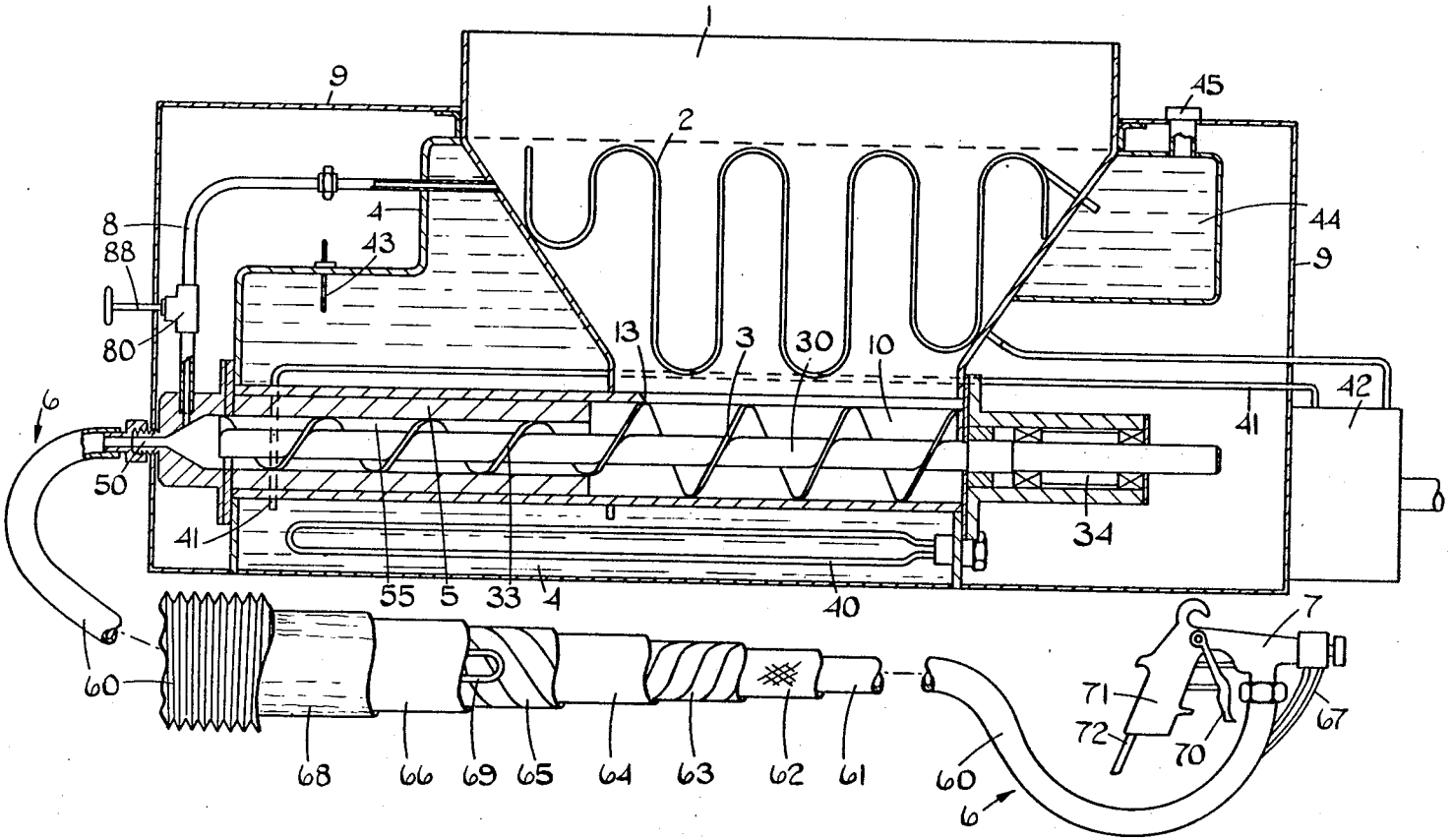
1
2
3
4
5
7
8
9
10
13
30
33
34
40
41
42
43
44
45
50
55
60
61
62
63
64
65
66
67
68
69
70
71
72
80
88

APPARATUS FOR DISPENSING MASTIC MATERIAL

BACKGROUND OF THE INVENTION

Field of the Invention

The object of this invention is to provide apparatus for dispensing mastic material such as butyl mastic sealant, e.g. for use in sealing double glazing window units or for other purposes whereby a continuous supply of the material ready for use can be provided. Practical advantages in this respect will be apparent from the following disclosure.

SUMMARY OF THE INVENTION

According to the invention apparatus for dispensing mastic material comprises a container for receiving mastic material; heating means for heating the mastic material in the container in order to soften said material, and feeding means within said container for feeding the softened mastic material from the container to an outlet therefrom.

BRIEF DESCRIPTION OF THE DRAWING

In a practical example of the apparatus the construction and arrangement is as follows, reference being had to the accompanying drawing which is a diagrammatic side elevation of the apparatus including an enlarged scale detail view of hose used with the apparatus and shown broken away to reveal construction.

DESCRIPTION OF A PRACTICAL EMBODIMENT

A container or hopper 1 is provided for receiving cold mastic material in block or granular form which first contacts heating means 2 where the material is pre-heated and softened prior to passing into a lower longitudinal receptacle 10 which latter is also heated to maintain the mastic material in a suitably fluid or plastic condition.

The heating means 2 may consist of one or more encased electric heating elements or, as shown, a tubular heating coil 2 is provided through which a heating fluid such as oil is circulated. The coil 2 is preferably arranged in a back and forth manner in several banks (e.g. four) of which one bank is visible in the drawing.

A major lower part of the hopper 1 and the lower receptacle 10 are housed in a tank 4 containing oil which is heated by an electric immersion heater or heaters 40 one of which is shown in the lower part of the tank 4. Hot oil from the vicinity of the heaters 40 is drawn via an inlet pipe 41 to a pump 42 for circulation through the coil 2 and return to an expansion tank 44, communicating with or forming an extension of the main oil tank 4. A thermostat at 43 controls the operation of the electric heaters 40. The operating temperature may be of the order of 225° C. (440° F.). The expansion tank 44 is provided with a filler inlet 45 for enabling both tanks 4 and 44 to receive an appropriate quantity of oil.

Feeding means for the softened mastic material is provided in the lower receptacle 10 and is shown consisting of an Archimedean screw or worm 3 carried by a shaft 30 arranged to be exteriorly driven, e.g. by direct motor drive (not shown). The action of the screw 3 is to impart feeding movement to the softened mastic material into a chamber or barrel 5 in which the shaft 30 carries a continuation screw 33 of smaller diameter in order to maintain feed movement and force the softened mastic material to an outlet 50 of the barrel 5.

The shaft 30 is supported for rotation by a bearing 34 at its driven end and by the working fit of the reduced diameter screw 33 in the bores 55 of the barrel 5. The periphery of the screw 3 cooperates with a fixed shearing edge at 13 on the barrel 5 in order to assist feed of the mastic material from the container 10 and hopper 1 into the barrel 5.

In use a pipe or flexible hose 6 is connected to the outlet 50 for passage of the softened mastic material to an applicator nozzle or gun 7 for sealing or other application of the material issuing from the gun 7. In order to maintain the mast material in the required softened condition up to the point of issue from the gun 7, the hose 6 and the gun 7 are also heated by electric heating means with external heat insulation to enable the gun 7 and hose 6 to be handled in use. Issue of the mastic material from the gun 7 is controlled by a valve therein operated by a trigger 70. When the trigger 70 is pulled back to open the valve it also operates a switch in the pistol grip handle 71 electrically connected at 72 in a control circuit of the motor driving the shaft 30 whereby the latter is driven for feed of mastic material when the trigger 70 is operated.

The hose 6 is of multi-layer construction comprising an innermost wall 61 of PTFE (polytetrafluoroethylene) for anti-friction flow of the mastic material, which all 61 is covered by a reinforcing layer 62 of stainless steel mesh bound by heat resistant tape 63 and contained in a silicone sheath 64. Provided about the sheath 64 is a spiral electric tape heater or heaters 65 in turn contained within a further silicone sheath 66. The assembly is then bound by a layer of ceramic fibre 68 for heat insulation and which is encased in a flexible plastic covered steel outer casing 60. A thermo-couple for controlling the operation of the or each tape heater 65 is indicated at 69. Electrical connection from the hose heater or heaters 65 to a heater in the gun 7 is shown at 67.

In order to regulate the flow of softened mastic material to the hose 6 and gun 7 a by-pass pipe 8 back to the hopper 1 communicates with the bore 55 of the barrel 5 just before the outlet 50, the by-pass pipework 8 including a regulating valve 80 in which the valve member is adjustable such as by screw operation at 88. The rate of delivery of mastic material can thus be controlled by appropriate setting of the valve 80 whereby softened mastic material excess to requirements is returned to the hopper 1 for re-circulation by the feed screw 3.

The apparatus is shown provided with outer casing at 9 which in practice may carry or incorporate a panel containing motor and heater switch controls, temperature indicators and associated electrical equipment and circuitry.

I claim:

1. Apparatus for dispensing mastic material comprising;

(a) a longitudinal receptacle for receiving mastic material;

(b) a hopper coupled to said longitudinal receptacle for receiving cold mastic material in block or granular form;

(c) a barrel having a bore communicating at one end with said longitudinal receptacle and providing an outlet therefrom at its other end;

(d) heating means in said hopper for initially softening cold mastic material in the hopper for gravity flow of the softened mastic material down into said longitudinal receptacle;

(e) a closed tank for containing a heat conductive liquid such as oil and housing at least the longitudinal receptacle and barrel;

(f) thermostatically controlled electric immersion heater means in said tank for heating the liquid therein for in turn heating the longitudinal receptacle and barrel in order to maintain mastic material in said receptacle and barrel in a required softened condition;

(g) a shaft along the interior of the longitudinal receptable and extending co-axially within and along the barrel, said shaft also extending exteriorly of the receptacle for driven rotation;

(h) a feed screw carried fast about the shaft in said receptacle for feeding softened mastic material therein to the barrel, a reduced diameter co-axial continuation of the feed screw having a close working fit in the bore of the barrel and being of corresponding bore size for forced feed of the softened mastic material along the bore and pressurized discharge thereof at the outlet end of said bore.

2. Apparatus for dispensing mastic material according to claim 1, wherein a fixed shearing edge is provided in the longitudinal receptacle adjacent the communication of the barrel therewith, said shearing edge cooperating with the periphery of the feed scew in the receptacle to assist feed of softened mastic material from the receptacle into the barrel.

3. Apparatus for dispensing mastic material according to claim 1, wherein a return flow pipe from the outlet end of the barrel back to the hopper is provided, said pipe including a screw-type, adjustable regulating valve for variable return flow of softened mastic material back to the hopper to regulate the rate of delivery of the softened mastic material from the outlet end of the barrel.

4. Apparatus for dispensing mastic material according to claim 1, wherein at least a lower part of the hopper is also housed in the tank for assisting in heating the hopper and maintaining the mastic material in the lower part of the hopper in a softened condition for gravity flow into the longitudinal receptacle.

5. Apparatus for dispensing mastic material according to claim 1 having in combination therewith mastic material applicator means comprising a hose connected to the outlet end of the barrel and an applicator gun connected to said hose, electric heating means being provided along the hose and at the gun for maintaining mastic supplied thereto by the dispensing apparatus in the softened condition suitable for application from the gun.

6. Apparatus for dispensing mastic material according to claim 5, wherein operation of the feed screw is electrically controlled by a control switch such as a trigger on the gun.

7. Apparatus for dispensing mastic material according to claim 6, wherein the control switch is also arranged to operate an outlet valve of the gun so as to open the valve and bring the feed screw driver into operation.

8. Apparatus for dispensing mastic material comprising;

(a) a longitudinal receptacle for receiving mastic material;

(b) a hopper coupled to said longitudinal receptacle for receiving cold mastic material in block or granular form;

(c) a barrel having a bore communicating at one end with said longitudinal receptacle and providing an outlet therefrom at its other end;

(d) a closed tank for containing a heat conductive liquid such as oil and housing at least the longitudinal receptacle and barrel;

(e) thermostatically controlled electric immersion heater means in said tank for heating the liquid therein for in turn heating the longitudinal receptacle and barrel in order to maintain mastic material in said receptacle and barrel in a required softened condition ;

(f) a tubular heating member of coil-like form disposed in the hopper so as to follow an extended path therein, said tubular member communicating at one end with the tank;

(g) a pump communicating with the tank and with the other end of the tubular heating member for pumping heated liquid for circulation therethrough and return to the tank in order to initially heat and soften cold mastic material received in the hopper for gravity flow of the softened mastic material into the longitudinal receptacle;

(h) a shaft along the interior of the longitudinal receptacle and extending co-axially within and along the barrel, said shaft also extending exteriorly of the receptacle for driven rotation;

(i) a feed screw carried fast about the shaft in said receptacle for feed of softened mastic material therein to the barrel, a reduced diamter co-axial continuation of the feed screw having a close working fit in the bore of the barrel and being of corresponding bore size for forced feed of the softened mastic material along the bore and pressurized discharge thereof at the outlet end of said bore.

* * * * *